US006679983B2

(12) United States Patent
Morrissey et al.

(10) Patent No.: US 6,679,983 B2
(45) **Date of Patent: *Jan. 20, 2004**

(54) METHOD OF ELECTRODEPOSITING COPPER

(75) Inventors: Denis Morrissey, Huntington, NY (US); Robert D. Mikkola, Grafton, MA (US); Jeffrey M. Calvert, Acton, MA (US)

(73) Assignee: Shipley Company, L.L.C., Marlborough, MA (US)

( * ) Notice: Subject to any disclaimer, the term of this patent is extended or adjusted under 35 U.S.C. 154(b) by 125 days.

This patent is subject to a terminal disclaimer.

(21) Appl. No.: 09/976,421

(22) Filed: Oct. 12, 2001

(65) Prior Publication Data

US 2002/0043467 A1 Apr. 18, 2002

Related U.S. Application Data

(60) Provisional application No. 60/240,643, filed on Oct. 16, 2000, and provisional application No. 60/240,142, filed on Oct. 13, 2000.

(51) Int. Cl.[7] ..... C25D 7/12; C25D 5/02; C25D 3/38

(52) U.S. Cl. ..... 205/157; 205/123; 205/291; 205/296

(58) Field of Search ..... 106/1.25, 1.26; 205/261, 291, 296, 157, 123

(56) References Cited

U.S. PATENT DOCUMENTS

| | | | | |
|---|---|---|---|---|
| 2,871,173 A | | 1/1959 | Castellano | 204/52 |
| 5,433,840 A | * | 7/1995 | Dahms et al. | 205/296 |
| 6,063,172 A | * | 5/2000 | Bokisa et al. | 106/1.22 |
| 6,444,110 B2 | * | 9/2002 | Barstad et al. | 205/123 |
| 6,531,046 B2 | * | 3/2003 | Morrissey et al. | 205/219 |
| 2002/0000382 A1 | * | 1/2002 | Morrissey et al. | 205/115 |
| 2002/0053519 A1 | * | 5/2002 | Morrissey et al. | 205/291 |
| 2002/0166774 A1 | * | 11/2002 | Schetty et al. | 205/252 |
| 2002/0187355 A1 | * | 12/2002 | Crosby | 428/432 |

FOREIGN PATENT DOCUMENTS

| | | | |
|---|---|---|---|
| EP | 0 952 242 A1 | | 10/1999 |
| NL | 73083 | * | 8/1953 |

OTHER PUBLICATIONS

Braun et al., "Electrodeposition of Copper From Acid Electrolytes Containing Nitrate Ions", Protection of Metals, vol. 26, No. 3, May 1, 1990, pp. 379–381.*

Braun et al., "Electrodeposition of Copper From Acid Electrolytes Containing Nitrate Ions", Protection of Metals, Plenum Publishing Co., New York, US, vol. 26, No. 3, May 1, 1990, pp. 379–381, XP000228101, ISSN: 0033–1732.

Database WPI, Section Ch., Wek 199218, Derwent Publications Ltd., Londin, GB; AN 1992–148450 XP002193404 & SU 1 650 786 A (Fomichev V T), May 23, 1991—Abstract.

"Chemical Abstracts + Indexes, American Chemical Society. Columbus, US" Chemical Abstracts + Indexes, American Chemical Society, Columbus, US, XP000193673, ISSN: 0009–2258—abstract, no date.

* cited by examiner

*Primary Examiner*—Edna Wong
(74) *Attorney, Agent, or Firm*—S. Matthew Cairns

(57) ABSTRACT

Disclosed are electrolytes for copper electroplating that provide enhanced fill of small features with less overplate. Also disclosed are methods of plating substrates, such as electronic devices, using such electrolytes.

14 Claims, No Drawings

METHOD OF ELECTRODEPOSITING COPPER

This application claims the benefit of U.S. Provisional Application(s) No(s).: Application No. 60/240,142 filed on Oct. 13, 2000 and U.S. Provisional Application No. 60/240,643 filed on Oct. 16, 2000.

BACKGROUND OF THE INVENTION

The present invention relates generally to the field of electroplating. In particular, the present invention relates to the use of certain acidic electrolytes in electroplating baths.

Electroplating articles with copper coatings is generally well known in the industry. Electroplating methods involve passing a current between two electrodes in a plating solution where one electrode is the article to be plated. A common plating solution would be an acid copper plating solution containing (1) a dissolved copper salt (such as copper sulfate), (2) an acidic electrolyte (such as sulfuric acid) in an amount sufficient to impart conductivity to the bath and (3) additives (such as surfactants, brighteners, levelers and suppressants) to enhance the effectiveness and quality of plating. See generally U.S. Pat. Nos. 5,068,013; 5,174,886; 5,051,154; 3,876,513; and 5,068,013 for a discussion of copper plating baths.

Over time, a number of improvements in electroplating techniques have been made as the articles to be plated evolved in degree of difficulty and standards for plating increased. However, even with such improvements circumstances exist that can lead to plating defects.

Copper plating technology has been particularly important in the manufacture of computer circuit boards. More specifically, during circuit board manufacture, copper electrical connections are provided between various board layers by plating board through holes whereby a thin conductive copper conductive is first applied, typically using electroless copper plating techniques, followed by electroplating copper from acid copper solutions. Copper plating is also employed in circuit board manufacture to plate outer layers where final circuitry is defined. For such applications, panel plating is typically employed, where the full circuit board surface is copper plated followed by photodefining circuitry with a photoresist and then etching in a subtractive process. Alternatively an additive process can be employed, where copper circuits are produced by plating between lines defined by a resist relief image.

More recently, copper plating also has been employed in semiconductor chip manufacture to provide chip interconnections, replacing aluminum conductors. Industry continually demands enhanced performance, including ultra large-scale integration and faster circuits. Consequently, chip interconnects are required at dimensions of 200 nm and less. At such geometries, the resistivity of aluminum (theoretically $2.65\times10^{-8}$ ohm/meter at room temperature) is considered too high to allow the electronic signal to pass at required speeds. Copper, with a theoretical resistivity of $1.678\times10^{-8}$ ohm/meter, is a more suitable material to meet the next generation of semiconductor microchips.

Typical processes for defining semiconductor chip interconnects, particularly aluminum interconnects, have involved reactive ion etching of metal layers, e.g. a process that includes metal deposition, photolithographic patterning, line definition through reactive ion etching and dielectric deposition. However, in copper-based systems, reactive ion etching is not practical as a result of the paucity of copper compounds with vapor pressures sufficient to enable removal of the copper as may be desired.

Consequently, alternative strategies have developed, such as the Damascene process. That process starts with deposition of dielectric typically by chemical vapor deposition of silicon materials or organic dielectrics followed by curing, or spin coating silicon materials or organic dielectrics. Patterning by photolithographic processes and reactive ion etching defines the vias and trenches (interconnects) in the dielectric. Barrier layers are then formed by chemical vapor deposition or other methods to isolate the copper lines from the dielectric. Copper is then deposited and excess material removed by chemical or mechanical polishing processes.

Although conventional copper plating systems can be suitable for plating vias and trenches as small as 300 nm with 4:1 aspect ratios, defects such as seams, voids and inclusions can occur with conventional methods when attempting to plate features that are smaller or have higher aspect ratios. Such defects can occur as a result of conformal copper plating, i.e. where all targeted surfaces are plated at the same rate such that the sidewalls of a via or trench plate together forming a seam or a demarcation of disruption where the copper grains are separated and will not anneal to form a continuous copper wire. Defects also will occur at the top rim of a via hole, where electronic charge density can concentrate and result in rapid copper growth that closes off the via before the via is filled sufficiently with metal. Such inadequate metal fill can result in inclusion and voids, disrupting the ability of the plated metal to carry a coherent signal.

A semiconductor wafer is generally plated with excess copper. During the process of manufacturing an integrated circuit, a semiconductor wafer is often polished to remove the excess unwanted materials on the surface of the wafer. Polishing generally takes the form of chemical-mechanical planarization ("CMP") wherein a chemically active slurry is used in conjunction with a polishing pad.

In many conventional electroplating baths numerous organic additives are used, including separate accelerator compounds, separate suppressor compounds and separate leveler compounds. Such organic additives are used to provide certain plating properties, such as good fill of recessed features and low overplating. This is particularly true in copper electroplating baths designed to provide superfill of small apertures during the manufacture of electronic devices, such as integrated circuits.

However, such organic additives can be problematic. A balance must be struck between the use of accelerators, suppressors and levelers to achieve the desired level of copper fill of apertures without void formation. Many factors may affect the stability and consumption of each of the accelerator, suppressor and leveler components in the plating bath. Thus, if one of these components is consumed at a faster rate than the others, the plating characteristics of the bath may change. Alternatively, if one of the organic additives is incorrectly added to the electroplating bath, either during bath make-up or replenishment, the plating characteristics of the bath may not be optimum. Thus, it is desirable to provide or enhance bottom-up fill (superfill) with less reliance on the use of organic additives.

SUMMARY OF THE INVENTION

It has been surprisingly found that the use of two or more acids in the electrolyte of an electroplating bath, particularly a copper electroplating bath, results in a metal deposit having good fill of recessed features with reduced overplating as compared to conventional plating baths using one acid for the electrolyte. The use of two or more acids in the electrolyte enhances bottom-up fill in the presence of organic additives and reduces the reliance on such additives. Such improved plating characteristics are particularly suitable for the manufacture of electronic devices where apertures of different sizes are present.

In one aspect, the present invention provides an electroplating bath including a) a source of metal ions; b) an electrolyte including two or more acids; c) and optionally one or more additives.

In a second aspect, the present invention provides a method of depositing a metal layer on a substrate including the steps of: a) contacting a substrate with an electroplating bath including a source of metal ions, an electrolyte including two or more acids, and optionally one or more additives; and b) subjecting the electroplating bath to a current density sufficient to deposit the metal layer.

In a third aspect, the present invention provides a method for manufacturing an electronic device including the steps of: a) contacting the electronic device with an electroplating bath including a source of metal ions, an electrolyte including two or more acids, and optionally one or more additives; and b) subjecting the electroplating bath to a current density sufficient to deposit the metal layer.

The invention also includes articles of manufacture, including electronic packaging devices such as printed circuit boards, multichip modules, semiconductor integrated circuits and the like that contain a copper deposit produced from a plating solution of the invention.

In a fourth aspect, the present invention provides an article of manufacture including an electronic device substrate containing one or more apertures, each aperture containing an electrolytic copper deposit obtained from an electroplating composition that includes at least one soluble copper salt and an electrolyte including two or more acids.

In a fifth aspect, the present invention provides a method for removing excess material from a semiconductor wafer by using a chemical mechanical planarization process which includes contacting the semiconductor wafer with a rotating polishing pad thereby removing the excess material from the semiconductor wafer; wherein the semiconductor wafer has been prior electroplated by a copper electroplating composition including at least one soluble copper salt, and an electrolyte including two or more acids.

In a sixth aspect, the present invention provides a method for removing excess material from a semiconductor wafer by using a chemical mechanical planarization process which includes contacting the semiconductor wafer with a rotating polishing pad thereby removing the excess material from the semiconductor wafer; wherein the semiconductor wafer has been prior electroplated by the composition described above.

DETAILED DESCRIPTION OF THE INVENTION

As used throughout the specification, the following abbreviations shall have the following meanings, unless the context clearly indicates otherwise: nm=nanometers; g/L=grams per liter; ASF=amperes per square foot; M=molar; and ppm=parts per million.

As used throughout the specification, "feature" refers to the geometries on a substrate, such as, but not limited to, trenches and vias. "Apertures" refer to recessed features, such as vias and trenches. The term "small features" refers to features that are one micron or smaller in size. "Very small features" refers to features that are one-half micron or smaller in size. Likewise, "small apertures" refer to apertures that are one micron or smaller in size and "very small apertures" refer to apertures that are one-half micron or smaller in size. As used throughout this specification, the term "plating" refers to metal electroplating, unless the context clearly indicates otherwise. "Deposition" and "plating" are used interchangeably throughout this specification. The term "accelerator" refers to a compound that enhances the plating rate. The term "suppressor" refers to a compound that suppresses the plating rate. "Halide" refers to fluoride, chloride, bromide, and iodide.

All percentages and ratios are by weight unless otherwise indicated. All ranges are inclusive and combinable.

The present invention provides certain electroplating baths that are capable of completely filling recessed small features and substantially or completely filling recessed large features, with reduced overplate as compared to conventional plating baths. Thus, the present electroplating baths are particularly suitable for use in the manufacture of electronic devices where superfill of recessed small features is desired.

"Superfill" or bottom-up fill occurs when metal plating at the bottom of features, particularly small features, is faster than plating occurring on the top surface of the substrate to be plated. "Conformal plating" occurs when metal plating following the surface topography is occurs at the same rate as metal plating in the bottom of features, such as trenches or vias. At times, conformal plating is desired, while at other times superfill plating is desired. In the manufacture of certain electronic devices, such as wafers used in the manufacture of integrated circuits or semiconductors having small or very small features, superfill plating is desired. Particularly desired is superfill copper electroplating in such electronic device manufacture.

In general, superfill deposition occurs when the deposition rate at the bottom of the features is greater than the deposition rate at the top surface of the substrate. While not intending to be bound by theory, it is believed that the deposition rate at the surface of the substrate is controlled by mass transport (convection) of the reactants in the plating bath and the magnitude of the current applied. It is further believed, while not intending to be bound by theory, that convection inside the features is unimportant when plating very small features and that the deposition rate inside the features is controlled by mass transport (diffusion).

Electroplating solutions of the present invention generally include at least one soluble copper salt and an acidic electrolyte including two or more acids. The electroplating solutions of the present invention may optionally contain one or more additives, such as halides, accelerators or brighteners, suppressors, levelers, grain refiners, wetting agents, surfactants and the like.

A variety of copper salts may be employed in the subject electroplating solutions, including for example copper sulfates, copper acetates, copper fluoroborate, and cupric nitrates. Copper sulfate pentahydrate is a particularly preferred copper salt. A copper salt may be suitably present in a relatively wide concentration range in the electroplating compositions of the invention. Preferably, a copper salt will be employed at a concentration of from about 1 to about 300 g/L of plating solution, more preferably at a concentration of from about 10 to about 225 g/L, still more preferably at a concentration of from about 25 to about 175 g/L. The copper plating bath may also contain amounts of other alloying elements, such as, but not limited to, tin, zinc, and the like. Thus, the copper electroplating baths useful in the present invention may deposit copper or copper alloy.

Plating baths of the invention employ an acidic electrolyte including two or more acids. Preferred electrolytes include two acids or three acids, and more preferably two acids. Suitable acids are inorganic or organic. Thus, the two or more acids useful in the present invention may be two or more inorganic acids, two or more organic acids, or a mixture of inorganic and organic acids. Suitable inorganic acids include, but are not limited to, sulfuric acid, phosphoric acid, nitric acid, hydrogen halide acids, sulfamic acid, fluoroboric acid and the like. Suitable organic acids include, but are not limited to, alkylsulfonic acids such as methanesulfonic acid, aryl sulfonic acids such as phenylsulfonic acid and tolylsulfonic acid, carboxylic acids such as formic acid, acetic acid and propionic acid, halogenated acids such as trifluoromethylsulfonic acid and haloacetic acid, and the like. Particularly suitable organic acids include ($C_1$–$C_{10}$) alkylsulfonic acids. Particularly suitable combinations of acids include one or more inorganic acids with one or more organic acids or a mixture of two or more organic acids.

Suitable mixtures of acids include, but are not limited to, sulfuric acid/methane sulfonic acid, fluoroboric acid/trifluoromethanesulfonic acid, sulfuric acid/methanesulfonic acid/phenylsulfonic acid, nitric acid/sulfuric acid/methanesulfonic acid, methanesulfonic acid/ethanesulfonic acid/phenylsulfonic acid, methanesulfonic acid/ethanesulfonic acid, methanesulfonic acid/ethanesulfonic acid/sulfuric acid, sulfuric acid/acetic acid/methanesulfonic acid, sulfuric acid/methanesulfonic acid/propionic acid, trichloroacetic acid/sulfuric acid, trichloroacetic acid/sulfuric acid/methanesulfonic acid, trichloroacetic acid/sulfuric acid/phenylsulfonic acid, and the like.

Typically, the two or more acids may be present in any ratio. For example, when two acids are used, they may be present in any ratio from 99:1 to 1:99. Preferably, the two acids are present in a ratio from 90:10 to 10:90, more preferably from 80:20 to 20:80, still more preferably from 75:25 to 25:75, and even more preferably from 60:40 to 40:60. When three or more acids are used, they may be used in any ratio. The two or more acids in the present electrolytes are not intended to include the minor amounts (typically less than 100 mg/L) of hydrogen halide acids conventionally used as a source of halide ions.

The total amount of added acid used in the present electroplating baths may be from about 1 to about 350 g/L, and preferably from 1 to 225 g/L. When two inorganic acids are used, it is preferred that each acid be present in an amount of at least about 0.5 g/L, preferably at least about 1 g/L, and more preferably at least about 2 g/L. It will be appreciated by those skilled in the art that by using a metal sulfate as the metal ion source, an acidic electrolyte can be obtained without any added acid. Thus, if a metal sulfate is used, only one additional acid needs to be added to provide an electrolyte having two or more acids. If a hydrogen halide acid is used, it is preferably used in an amount greater than 50 mg/L, more preferably greater than or equal to 100 mg/L, still more preferably greater than or equal to 200 mg/L, and even more preferably greater than or equal to 500 mg/L.

For certain applications, such as in the plating of wafers having very small apertures, it is preferred that the total amount of added acid be low. By "low acid" is meant that the total amount of added acid in the electrolyte is less than about 0.4 M, preferably less than about 0.3 M, and more preferably less than about 0.2 M.

The present mixed acid electrolytes may optionally contain one or more halides, and preferably do contain at least one halide. Chloride and bromide are preferred halides, with chloride being more preferred. A wide range of halide ion concentrations (if a halide ion is employed) may be suitably utilized, e.g. from about 0 (where no halide ion employed) to 100 ppm of halide ion in the plating solution, more preferably from about 25 to about 75 ppm. Such halides may be added as the corresponding hydrogen halide acid or as any suitable salt.

A wide variety of brighteners (or accelerators), including known brightener agents, may be employed in the copper electroplating compositions of the invention. Typical brighteners contain one or more sulfur atoms, and typically without any nitrogen atoms and a molecular weight of about 1000 or less. Brightener compounds that have sulfide and/or sulfonic acid groups are generally preferred, particularly compounds that comprise a group of the formula R'—S—R—$SO_3X$, where R is an optionally substituted alkyl (which include cycloalkyl), optionally substituted heteroalkyl, optionally substituted aryl group, or optionally substituted heteroalicyclic; X is a counter ion such as sodium or potassium; and R' is hydrogen or a chemical bond (i.e. —S—R—$SO_3X$ or substituent of a larger compound). Typically alkyl groups will have from one to about 16 carbons, more typically one to about 8 or 12 carbons. Heteroalkyl groups will have one or more hetero (N, O or S) atoms in the chain, and preferably have from 1 to about 16 carbons, more typically 1 to about 8 or 12 carbons. Carbocyclic aryl groups are typical aryl groups, such as phenyl and naphthyl. Heteroaromatic groups also will be suitable aryl groups, and typically contain 1 to about 3 N, O or S atoms and 1–3 separate or fused rings and include e.g. coumarinyl, quinolinyl, pyridyl, pyrazinyl, pyrimidyl, furyl, pyrrolyl, thienyl, thiazolyl, oxazolyl, oxidizolyl, triazole, imidazolyl, indolyl, benzofuranyl, benzothiazol, and the like. Heteroalicyclic groups typically will have 1 to 3 N, O or S atoms and from 1 to 3 separate or fused rings and include e.g. tetrahydrofuranyl, thienyl, tetrahydropyranyl, piperdinyl, morpholino, pyrrolindinyl, and the like. Substituents of substituted alkyl, heteroalkyl, aryl or heteroalicyclic groups include e.g. $C_{1-8}$ alkoxy; $C_{1-8}$ alkyl, halogen, particularly F, Cl and Br; cyano, nitro, and the like.

More specifically, useful brighteners include those of the following formulae:

$XO_3S—R—SH$ $XO_3S—R—S—S—R—SO_3X$ and $XO_3S—Ar—S—S—AR—SO_3X$ where in the above formulae R is an optionally substituted alkyl group, and preferably is an alkyl group having from 1 to 6 carbon atoms, more preferably is an alkyl group having from 1 to 4 carbon atoms; Ar is an optionally substituted aryl group such as optionally substituted phenyl or naphthyl; and X is a suitable counter ion such as sodium or potassium.

Some specific suitable brighteners include e.g. n,n-dimethyl-dithiocarbamic acid-(3-sulfopropyl)ester; 3-mercapto-propylsulfonic acid-(3-sulfopropyl)ester; 3-mercaptopropylsulfonic acid (sodium salt); carbonic acid-dithio-o-ethylester-s-ester with 3-mercapto-1-propane sulfonic acid (potassium salt); bissulfopropyl disulfide; 3-(benzthiazolyl-s-thio)propyl sulfonic acid (sodium salt); pyridinium propyl sulfobetaine; 1-sodium-3-mercaptopropane-1-sulfonate; sulfoalkyl sulfide compounds disclosed in U.S. Pat. No. 3,778,357; the peroxide oxidation product of a dialkyl amino-thiox-methyl-thioalkanesulfonic acid; and combinations of the above. Additional suitable brighteners are also described in U.S. Pat. Nos. 3,770,598, 4,374,709, 4,376,685, 4,555,315, and 4,673,469, all incorporated herein by reference. Particularly preferred brighteners for use in the plating compositions of the invention are n,n-dimethyl-dithiocarbamic acid-(3-sulfopropyl)ester and bis-sodium-sulfonopropyl-disulfide.

The amount of such accelerators present in the electroplating baths is in the range of from about 0.1 to about 1000 ppm. Preferably, the accelerator compounds are present in an amount of from about 0.5 to about 300 ppm, more preferably from about 1 to about 100 ppm, and still more preferably from about 2 to about 50 ppm.

The suppressor agents useful in the compositions of the invention are polymeric materials, preferably having heteroatom substitution, particularly oxygen linkages. Generally preferred suppressor agents are generally high molecular weight polyethers, such as those of the following formula:

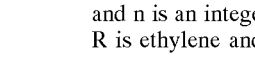

$$R—O—(CXYCX'Y'O)_nH$$

where R is an aryl or alkyl group containing from about 2 to 20 carbon atoms; each X, Y, X' and Y' is independently hydrogen, alkyl preferably methyl, ethyl or propyl, aryl such as phenyl; aralkyl such as benzyl; and preferably one or more of X, Y, X' and Y' is hydrogen; and n is an integer between 5 and 100,000. Preferably, R is ethylene and n is greater than 12,000.

The amount of such suppressors present in the electroplating baths is in the range of from about 0.1 to about 1000 ppm. Preferably, the suppressor compounds are present in an amount of from about 0.5 to about 500 ppm, and more preferably from about 1 to about 200 ppm.

Surfactants may optionally be added to the electroplating baths. Such surfactants are typically added to copper electroplating solutions in concentrations ranging from about 1 to 10,000 ppm based on the weight of the bath, more preferably about 5 to 10,000 ppm. Particularly suitable surfactants for plating compositions of the invention are commercially available polyethylene glycol copolymers, including polyethylene glycol copolymers. Such polymers are available from e.g. BASF (sold by BASF under TETRONIC and PLURONIC tradenames), and copolymers from Chemax.

Levelers may optionally be added to the present electroplating baths. It is preferred that one or more leveler components is used in the present electroplating baths. Such levelers may be used in amounts of from about 0.01 to about 50 ppm. Examples of suitable leveling agents are described and set forth in U.S. Pat. Nos. 3,770,598, 4,374,709, 4,376,685, 4,555,315 and 4,673,459. In general, useful leveling agents include those that contain a substituted amino group such as compounds having R—N—R', where each R and R' is independently a substituted or unsubstituted alkyl group or a substituted or unsubstituted aryl group. Typically the alkyl groups have from 1 to 6 carbon atoms, more typically from 1 to 4 carbon atoms. Suitable aryl groups include substituted or unsubstituted phenyl or naphthyl. The substituents of the substituted alkyl and aryl groups may be, for example, alkyl, halo and alkoxy.

More specifically, suitable leveling agents include, but are not limited to, 1-(2-hydroxyethyl)-2-imidazolidinethione; 4-mercaptopyridine; 2-mercaptothiazoline; ethylene thiourea; thiourea; alkylated polyalkyleneimine; phenazonium compounds disclosed in U.S. Pat. No. 3,956,084; N-heteroaromatic rings containing polymers; quaternized, acrylic, polymeric amines; polyvinyl carbamates; pyrrolidone; and imidazole. A particularly preferred leveler is 1-(2-hydroxyethyl)-2-imidazolidinethione.

The present copper electroplating compositions are suitably used in similar manner as prior copper electroplating baths. Plating baths of the invention are preferably employed at or above room temperature, e.g. up to 65° C. and greater. The plating composition is preferably agitated during use such as by air sparger, work piece agitation, impingement or other suitable method. Plating is preferably conducted at a current ranging from 1 to 40 ASF depending upon substrate characteristics. Plating time may range from about 5 minutes to 1 hour or more, depending on the difficulty of the work piece.

A wide variety of substrates may be plated with the compositions of the invention, as discussed above. The compositions of the invention are particularly useful to plate difficult work pieces, such as circuit board substrates with small diameter, high aspect ratio microvias and other apertures. The plating compositions of the invention also will be particularly useful for plating integrated circuit devices, such as formed semiconductor devices and the like. The compositions of the invention are particularly suitable for plating high aspect ratio microvias and trenches, such as those having aspect ratios of 4:1 or greater.

As discussed above, aspect ratios of at least 4:1, having diameters of about 200 nm or smaller have been effectively copper plated with no defects (e.g. no voids or inclusions by ion beam examination) using plating solutions of the invention. Apertures with diameters below 150 nm, or even below about 100 nm, and aspect ratios of 5:1, 6:1, 7:1, 10:1 or greater, and even up to about 15:1 or greater can be effectively plated (e.g. no voids or inclusions by ion beam examination) using plating solutions of the invention.

Thus, the present invention provides a method of depositing a metal layer on a substrate including the steps of: a) contacting a substrate with an electroplating bath including a source of metal ions, an electrolyte including two or more acids, and optionally one or more additives; and b) subjecting the electroplating bath to a current density sufficient to deposit the metal layer.

A wide variety of substrates may be plated with copper according to the present invention. Particularly suitable are substrates used in the manufacture of electronic devices, such as wafers used in the manufacture of integrated circuits, printed wiring board inner layers and outer layers, flexible circuits and the like. It is preferred that the substrate is a wafer.

The present invention also provides a method for manufacturing an electronic device including the steps of: a) contacting the electronic device with an electroplating bath including a source of metal ions, an electrolyte including two or more acids, and optionally one or more additives; and b) subjecting the electroplating bath to a current density sufficient to deposit the metal layer.

Accordingly, the present invention also provides an article of manufacture including an electronic device substrate containing one or more apertures, each aperture containing an electrolytic copper deposit obtained from an electroplating composition that includes at least one soluble copper salt and an electrolyte including two or more acids.

Once a semiconductor wafer is plated according to the present invention, the wafer is preferably subjected to chemical-mechanical planarization ("CMP"). A CMP procedure can be conducted in accordance with the invention as follows.

The wafer is mounted in a wafer carrier which urges the wafer against the surface of a moving polishing pad. The polishing pad can be a conventional smooth polishing pad or a grooved polishing pad. Examples of a grooved polishing pad are described in U.S. Pat. Nos. 5,177,908; 5,020,283; 5,297,364; 5,216,843; 5,329,734; 5,435,772; 5,394,655; 5,650,039; 5,489,233; 5,578,362; 5,900,164; 5,609,719; 5,628,862; 5,769,699; 5,690,540; 5,778,481; 5,645,469; 5,725,420; 5,842,910; 5,873,772; 5,921,855; 5,888,121; 5,984,769; and European Patent 806267. The polishing pad can be located on a conventional platen can rotate the polishing pad. The polishing pad can be held on the platen by a holding means such as, but not limited to, an adhesive, such as, two faced tape having adhesive on both sides.

A polishing solution or slurry is fed onto the polishing pad. The wafer carrier can be at a different positions on the polishing pad. The wafer can be held in position by any suitable holding means such as, but is not limited to, a wafer holder, vacuum or liquid tensioning such as, but not limited to a fluid such as, but not limited to water. If the holding means is by vacuum then there is preferably a hollow shaft which is connected to the wafer carrier. Additionally, the hollow shaft could be used to regulate gas pressure, such as, but not limited to air or an inert gas or use a vacuum to initially hold the wafer. The gas or vacuum would flow from the hollow shaft to the carrier. The gas can urge the wafer against the polishing pad for the desired contour. The vacuum can initially hold the wafer into position in the wafer carrier. Once the wafer is located on top of the polishing pad the vacuum can be disengaged and the gas pressure can be engaged to thrust the wafer against the polishing pad. The excess or unwanted copper is then removed. The platen and wafer carrier can be independently rotatable. Therefore, it is possible to rotate the wafer in the same direction as the polishing pad at the same or different speed or rotate the wafer in the opposite direction as the polishing pad.

Thus, the present invention provides a method for removing excess material from a semiconductor wafer by using a chemical mechanical planarization process which includes contacting the semiconductor wafer with a rotating polishing pad thereby removing the excess material from the semiconductor wafer; wherein the semiconductor wafer has been prior electroplated by a copper electroplating composition including at least one soluble copper salt, and an electrolyte including two or more acids.

Also provided is a method for removing excess material from a semiconductor wafer by using a chemical mechanical planarization process which includes contacting the semiconductor wafer with a rotating polishing pad thereby removing the excess material from the semiconductor wafer; wherein the semiconductor wafer has been prior electroplated by the composition described above.

While the present invention has been described with respect to copper electroplating baths, it will be appreciated by those skilled in the art that the present mixed acid electrolyte may be used with a variety of plating baths, such as tin, tin alloy, nickel, nickel-alloy, and the like.

What is claimed is:

1. A method of depositing a layer of copper on a semiconductor device comprising the steps of: a) contacting the semiconductor device with an electroplating bath comprising at least one soluble copper salt, an electrolyte comprising two or more acids, and optionally one or more additives; and b) subjecting the electroplating bath to a current density sufficient to deposit the layer of copper; wherein the acids comprise a mixture of inorganic and organic acids; and wherein the semiconductor device comprises apertures having a size of less than or equal to one micron.

2. The method of claim 1 wherein the organic acids are chosen from alkylsulfonic acids, aryl sulfonic acids, carboxylic acids and halogenated acids.

3. The method of claim 1 wherein the inorganic acids are chosen from sulfuric acid, phosphoric acid, nitric acid, hydrogen halide acids, sulfamic acid and fluoroboric acid.

4. The method of claim 1 wherein the two or more acids are present in amount of from about 1 to about 350 g/L.

5. The method of claim 1 wherein the soluble copper salt is chosen from copper sulfates, copper acetates, copper fluoroborate, and cupric nitrates.

6. The method of claim 1 wherein the soluble copper salt is present in an amount of from about 1 to about 300 g/L.

7. The method of claim 1 wherein the one or more additives are chosen from accelerators, suppressors, levelers, grain refiners and wetting agents.

8. A method for manufacturing an electronic device comprising the steps of: a) contacting the electronic device with an electroplating bath comprising at least one soluble copper salt, an electrolyte comprising two or more acids, and optionally one or more additives; and b) subjecting the electroplating bath to a current density sufficient to deposit a layer of copper; wherein the acids comprise a mixture of inorganic and organic acids; and wherein the electronic device is a semiconductor device comprising apertures having a size of less than or equal to one micron.

9. The method of claim 8 wherein the organic acids are chosen from alkylsulfonic acids, aryl sulfonic acids, carboxylic acids and halogenated acids.

10. The method of claim 8 wherein the inorganic acids are chosen from sulfuric acid, phosphoric acid, nitric acid, hydrogen halide acids, sulfamic acid and fluoroboric acid.

11. The method of claim 8 wherein the two or more acids are present in an amount of from about 1 to about 350 g/L.

12. The method of claim 8 wherein the soluble copper salt is chosen from copper sulfates, copper acetates, copper fluoroborate, and cupric nitrates.

13. The method of claim 8 wherein the soluble copper salt is present in an amount of from about 1 to about 300 g/L.

14. The method of claim 8 wherein the one or more additives are chosen from accelerators, suppressors, levelers, grain refiners and wetting agents.

* * * * *